United States Patent [19]

Yarur et al.

[11] 3,978,841

[45] Sept. 7, 1976

[54] FEEDING APPARATUS FOR BALL PROJECTING MACHINE

[76] Inventors: Alfredo S. Yarur, 2101 Yorkgate Drive; Alfredo F. Yarur, 4513 Edwards Mill Road; Nicholas J. Yarur, 2101 Yorkgate Drive, all of Raleigh, N.C. 27612

[22] Filed: Apr. 3, 1975

[21] Appl. No.: 564,596

[52] U.S. Cl. ..... 124/50; 124/51 R

[51] Int. Cl.[2] ..... F41B 15/00

[58] Field of Search ..... 124/1, 30 R, 80, 48–51; 221/265; 222/216; 273/26 D

[56] References Cited

UNITED STATES PATENTS

| | | | |
|---|---|---|---|
| 1,475,730 | 11/1923 | Walter | 221/265 X |
| 3,785,358 | 1/1974 | D'Angelo et al. | 124/1 |

*Primary Examiner*—Richard C. Pinkham
*Assistant Examiner*—William R. Browne
*Attorney, Agent, or Firm*—B. B. Olive

[57] ABSTRACT

An improved feeding apparatus provides reliable feeding of balls from the supply hopper to the feed tube of a conventional ball projecting machine. A disc with a selected number of apertures, large enough to hold up to two balls, rotates below the supply hopper and above a support plate to randomly receive balls from the supply hopper for delivery of the balls at regular, predetermined intervals to the feed tube. A curved, inclined ramp adjacent the feed tube opening insures that only one ball will be allowed to enter the feed tube opening should two balls reside in each disc aperture. The balls in the disc apertures roll along on the support plate and protrude above the disc as it rotates thereby stirring the balls in the supply hopper and reducing the chance of bridging or jamming.

3 Claims, 12 Drawing Figures

FIG. 10
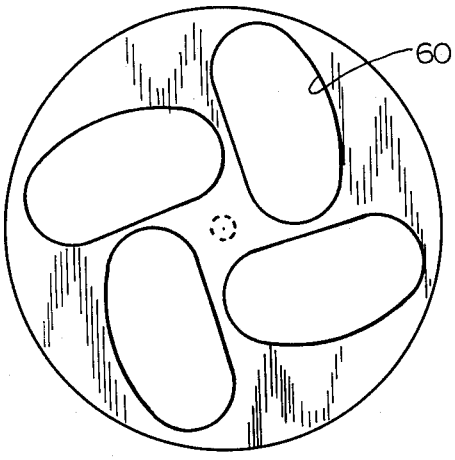
FIG. 11
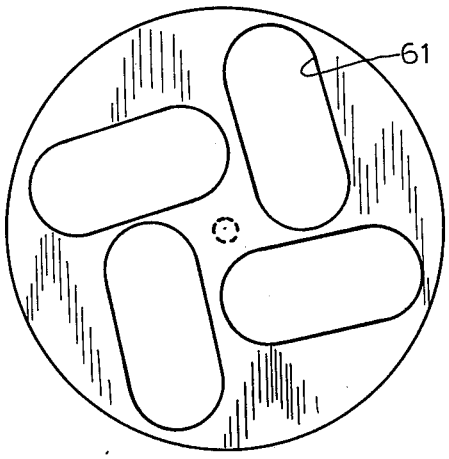
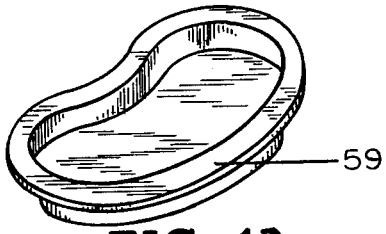
FIG. 12

FEEDING APPARATUS FOR BALL PROJECTING MACHINE

CROSS-REFERENCE TO RELATED APPLICATION

This application is related to copending application Ser. No. 484,605, now U.S. Pat. No. 3,913,522, entitled "Device Having Coacting Wheels for Projecting Tennis Balls".

BACKGROUND OF THE INVENTION

1. Field of the Invention

The invention relates to machines for projecting balls of various types during practice sessions. Specifically, this invention relates to a feeding mechanism for delivering tennis balls from a ball supply hopper to a feed tube at predetermined intervals.

2. Description of the Prior Art

The sport of tennis has gained in popularity throughout the past decade as an individual as well as a team sport. Where tennis is being taught, whether in schools, athletic clubs or other institutions, there is frequently a need for a type of ball throwing machine which can be used during practice sessions to simulate game-like situations for the benefit of the individual novice or professional. Most machines which have been devised to date for throwing tennis balls, baseballs, or the like, have a hopper located above the propelling mechanism and which contains the ball supply. The balls from the hopper are fed into a feed tube for delivering the balls to the propelling mechanism. Those skilled in the art have encountered considerable difficulty in developing a mechanism for feeding balls into the feed tube without delays in the feeding due to bridging or jamming of the balls in the supply hopper immediately above the feed mechanism. U.S. Pat. Nos. 3,339,660; 3,785,358; 3,766,901; and 3,277,879 are illustrative of the feeding mechanism of the prior art.

The apparatus of the present invention is adapted to be used on the throwing machine disclosed in U.S. Pat. No. 3,77,732 or similar machines having a hopper and feed tube. U.S. Pat. No. 377,732 is hereby incorporated by reference to supplement the disclosure provided herein.

SUMMARY OF THE INVENTION

A ball projecting machine of the type having a hopper for holding a supply of balls and a feed tube for receiving the balls from the hopper and delivering them to the projecting mechanism is provided with a greatly improved mechanism for feeding balls from the hopper to the feed tube at predetermined intervals. A disc with a selected number of apertures large enough to hold up to two balls rotates below the hopper and above a stationary ball support plate and receives balls from the hopper. When two balls are received by the aperture, they follow the path of the aperture until a first ball falls from the aperture, through a hole in a support plate, and into the feed tube. The second ball is elevated by a ramp which is adjacent to the hole and thereby urges the first ball into the hole. The invention greatly reduces the chance of the ball delivery being delayed due to "bridging" or "jamming" of balls in the hopper. The protrusion of the balls above the disc operates to stir the balls in the hopper as the disc rotates. Furthermore, if each aperture initially receives two balls, the disc must make two revolutions without receiving a ball before it will not discharge one into the feed tube. If an aperture holds only one ball as it passes above the feed tube, that ball will be guided into the tube by the ramp.

FIGURE DESCRIPTIONS

FIG. 10 is a view of a slightly modified alternate embodiment of the disc apertures.

FIG. 11 is a view of another alternate embodiment of the disc apertures.

FIG. 12 is a view of a cup designed to fit within a disc aperture of the preferred embodiment.

DESCRIPTION OF THE PREFERRED EMBODIMENT

Figure 1:
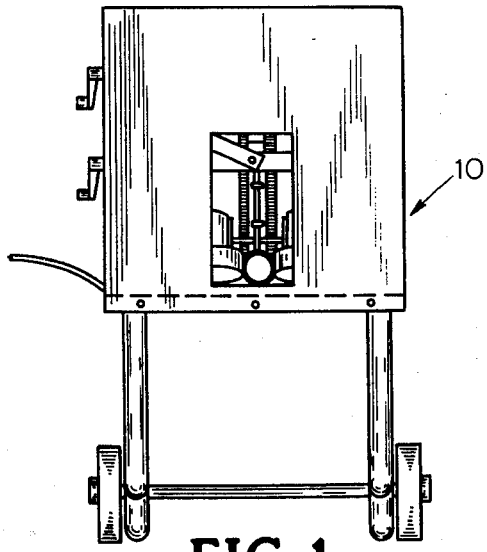
FIG. 1 is a front view of a conventional ball projecting machine of the type having a feed tube.

FIG. 1 is a front view of a conventional tennis ball projecting machine 10 of the type disclosed in U.S. Pat. No. 3,777,732 having a supply hopper and a feed tube and which requires a feed mechanism such as the subject of the present invention.

Figure 2:
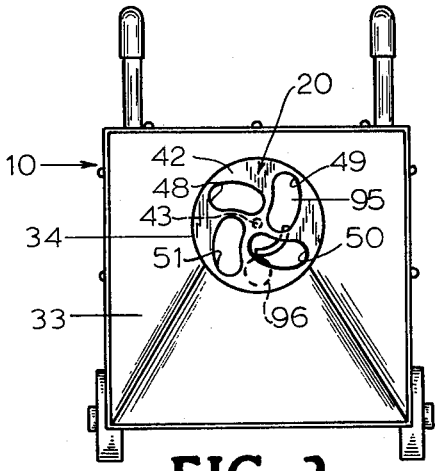
FIG. 2 is a top view of the machine of FIG. 1 showing the supply hopper and the feed apparatus of the present invention.
Figure 3:
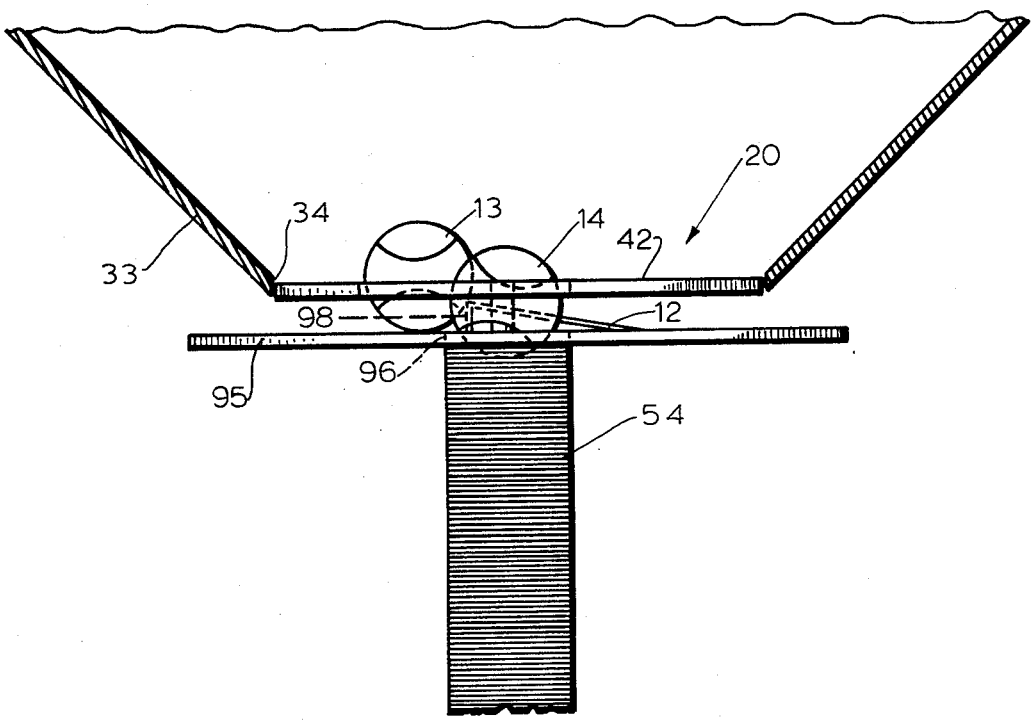
FIG. 3 is a fragmentary, section side view of the supply hopper, feed tube and feed apparatus.

In the preferred embodiment, the ball feed apparatus of the invention, generally identified by 20, is suitably secured to the frame of machine 10 and is situated immediately beneath the bottom opening 34 of hopper 33 (FIGS. 2 and 3). A rotatable, apertured disc 42 is adapted to rotate below opening 34 with drive shaft 43 which is driven by a variable speed drive motor (not shown). Apertured disc 42 has four apertures 48, 49, 50, 51, each of which is adapted to temporarily contain up to two tennis balls and through which each ball passes from hopper 33 to flexible tube 54. A support plate 95 below disc 42 provides a temporary ball support surface for the balls while they are in the apertures. Flexible feed tube 54 is secured to plate 95 by any suitable clamping or fastening means, not shown, and mates with a hole 96 in plate 95. Thus, as disc 42 rotates at a selected speed and as the apertures 48, 49, 50, 51 in disc 42, each containing at least one ball, pass over hole 96 of plate 95, one ball from each aperture will be permitted to fall freely from its respective aperture 48, 49, 50, 51 through hole 96 and into flexible feed tube 54. This operation is later explained.

The opposite end of feed tube 54 is connected by suitable means to the adjacent ball ejecting mechanism of conventional ball projecting machine 10.

Figure 4:
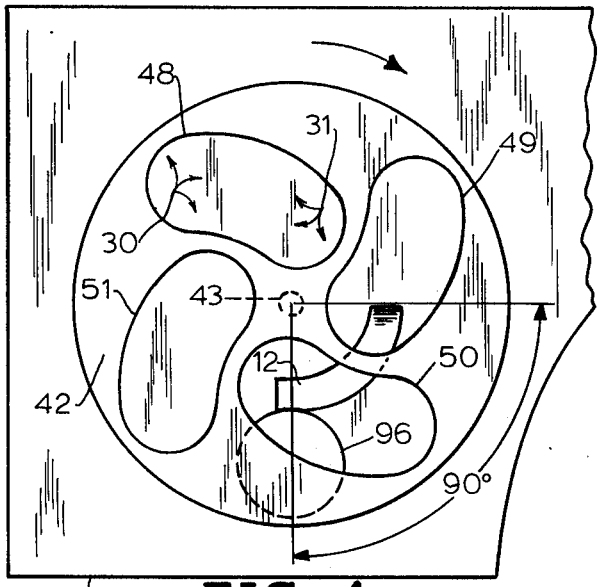
FIG. 4 is an enlarged fragmentary top view of the feed apparatus of the present invention.

Referring to FIG. 4, apertured disc 42 has four kidney-shaped apertures 48, 49, 50, 51 which are adapted to hold up to two balls each. The apertures are shaped and positioned so that each aperture has an outward-trailing section 30 which can hold a first ball and an inward-leading section 31 which can hold a second ball. As disc 42 rotates, the balls in apertures 48, 49 50, 51 are forced toward the outward-trailing section 30 of each aperture by two forces: (a) the frictional force between the ball and plate 95, which force varies with the number of balls piled up in hopper 33, and (b) the centrifugal force created by the rotation of disc 42. Of course, the centrifugal force varies with the speed of rotation so that at low operating speeds, the frictional force dominates and at very high speeds the centrifugal force dominates. At any speed, however, both forces tend to move the ball or balls in the apertures toward the outward-trailing section 30. It has been found that the kidney-shaped apertures provide a shape which most easily allows the inward-leading ball to move to the outward-trailing position since the ball moves substantially along the outer curved surfaces of the kidney-shaped aperture. Another advantage of the kidney shape is that the shape permits the use of a smaller disc 42 because of the inter-fitting of the apertures. In the preferred embodiment, disc 42 is twelve inches in diameter, yet it can hold up to eight tennis balls in the four kidney-shaped apertures.

It can be seen that when only one ball is occupying an aperture, that ball will be forced to the outward-trailing section 30 therby leaving the inward-leading section 31 open to receive a second ball from hopper 33.

A curved inclined ramp 12 is located on plate 95 on the ball-approach side of hole 96. Ramp 12 follows the path of inward-leading ball 13 and elevates ball 13 as it approaches hole 96. The function of ramp 12 will become clear upon tracing the path of a single aperture during one rotation as shown in FIGS. 5 through 9.

Figure 5:
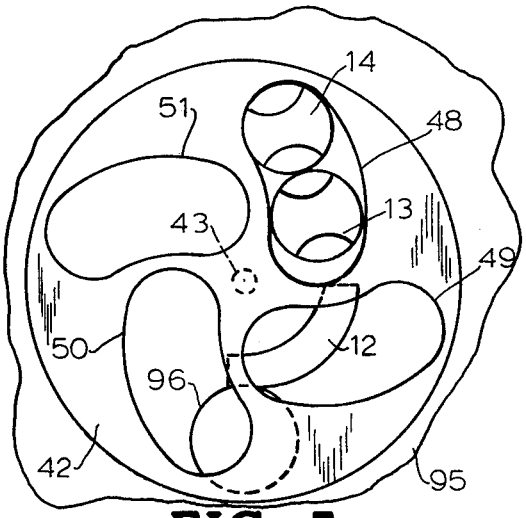
FIG. 5 is a top view of the feed apparatus as one of the apertures with two balls therein approaches the feed tube.
Figure 6:
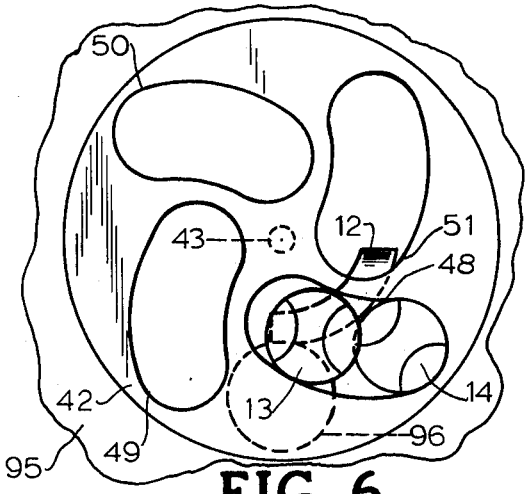
FIG. 6 is a view similar to FIG. 5 showing the same aperture as the inner ball is elevated by the ramp.

FIG. 5 illustrates one aperture in disc 42 as it holds two balls and approaches ramp 12. FIG. 6 shows the same aperture after it has rotated to a position where the inward-leading ball 13 has moved a distance along ramp 12. At this point, ball 13 is exerting a force with a downward component on ball 14 thereby urging ball 14 toward hole 96. This further elevation of ball 13 above the disc also aids in stirring the balls in the hopper to avoid the formation of bridges.

Figure 7:
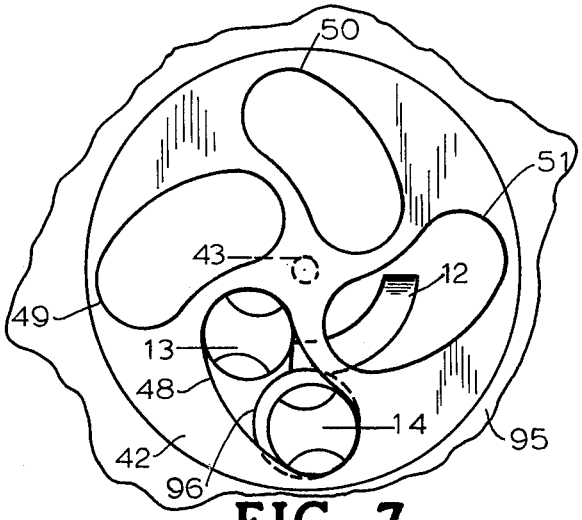
FIG. 7 is a view similar to FIGS. 5 and 6 showing the same aperture as the outer ball drops into the feed tube and the inner ball is prevented from entering the feed tube by the ramp.

FIG. 7 illustrates the position where the outward-trailing ball 14 begins to enter hole 96 and inward-leading ball 13 has passed beyond the inclined ramp and has dropped back down onto plate 95. It can be seen that ramp 12 not only aids in forcing ball 14 into hole 96 but also operates as a barrier to keep ball 13 from following ball 14 into hole 96. In these instances when there is only one ball in the aperture when it approaches hole 96, ramp 12 operates to guide the single ball to the outward-trailing section of the aperture and into hole 96.

Figure 8:
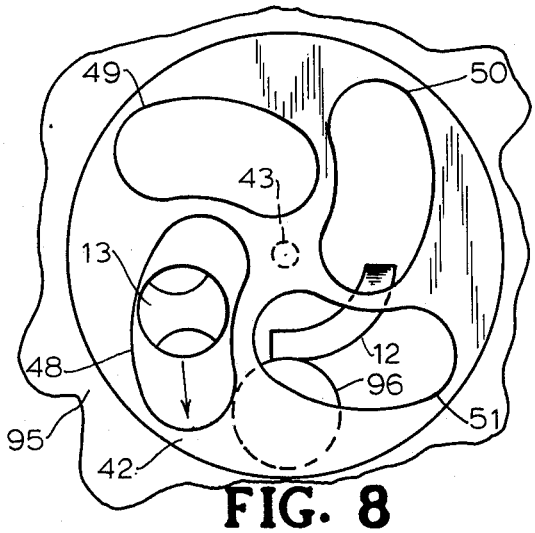
FIG. 8 shows the same aperture after passing the feed tube, with only one ball remaining.
Figure 9:
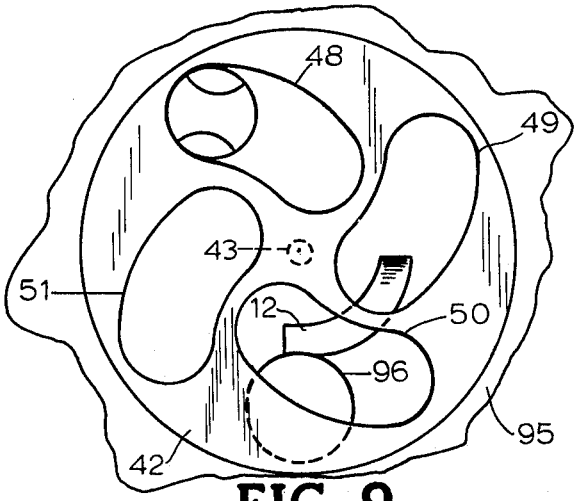
FIG. 9 shows the same aperture after the remaining ball moves to the outer position.

FIG. 8 shows the position where the outward ball has already fallen through hole 96 and the remaining ball is beginning to move toward the outward-trailing section. FIG. 9 shows the remaining ball after it has moved to the outward-trailing section. At this point another ball can move into the aperture so the cycle can begin again (FIG. 5).

As an alternative to the sequence depicted in FIGS. 7–9, it is possible that a second ball will replace the ball which has fallen into hole 96 immediately after it falls and before the remaining ball has a chance to move to the outward-trailing section and take its place.

The present invention greatly increases the probability of at least one ball being present in an aperture each time it passes over hole 96 for at least the following reasons:

a. The apertures are much larger than the apertures in the prior art which hold only one ball. Thus there is a much greater chance that when an aperture is empty it will pick up at least one ball, and usually two balls.

b. When an aperture is holding two balls, it will have to make two complete rotations without picking up an additional ball before it will be empty when passing over hole 96 and thus not discharge a ball. This has proven to be highly unlikely.

c. The protrusion of the balls above disc 42 while it rotates has been found to cause sufficient stirring to prevent the formation of bridges. The additional elevation of the inward ball by ramp 12 also causes considerable stirring action. Of course, less stirring is required since the apertures are large enough to hold two balls.

While the shape and position of the apertures in the preferred embodiment is believed to produce the best results, the apertures could have different shapes, two of which are illustrated in FIGS. 10 and 11 and referred to as apertures 60 and 61 respectively.

It is contemplated that the rotation of disc 42 will be coordinated with the horizontal and/or vertical displacement controls of the propelling mechanism in order to program machine 10. A feature of such a programmed machine is that cups 59 (see FIG. 12) can be inserted in selected ones of apertures 48, 49, 50, 51 to block passage of the balls. For example, if machine 10 is programmed so that apertures 48 and 50 release balls to be ejected down the center of the tennis court and balls from aperture 49 go to the left and balls 51 go to the right, then by placing cups in apertures 48 and 50 the balls would be thrown only to the left and right.

In operation, a number of balls are loaded into supply hopper 33. The disc drive motor is energized so as to rotate disc 42 at a selected constant speed in one direction. The balls begin to fall into apertures 48, 49, 50, 51 in disc 42 and follow the rotation of disc 42 above plate 95. The balls are forced toward the outward trailing section 30 of each aperture 48, 49, 50, 51. As each aperture containing two balls approaches hole 96, the inward-leading ball is elevated by curved ramp 12 so as to stir the balls in hopper 33 and to urge the outward-trailing ball into hole 96. If an aperture contains only one ball as it approaches hole 96, ramp 12 will guide the ball into hole 96. Only in very rare instances will an aperture be empty as it approaches hold 96 and cause the machine to miss a throw.

In the preferred embodiment curved ramp 12 comprises a ½ inch wide strip of metal cut from plate 95 and bent upward. A support piece 98 (FIG. 3) connects the upward end of the ramp to plate 95 for strength. Ramp 12 could be formed from a strip of plastic or metal suitably secured to plate 95; however, by cutting ramp 12 from plate 95 there is no obstruction as inward-leading ball 13 begins to ascend the ramp. Ramp 12 preferably follows the last 90° of the course of inward-leading ball 13 as it approaches hole 96. The height of ramp 12 at its highest point must, of course, be less than the distance between disc 42 and plate 95. For use with tennis balls of 2½ inch diameter it is preferred that disc 42 rotate approximately 1¼ inch above plate 95 and that ramp 12 have a constant slope along its 90° course until it reaches a maximum height of approximately 1 inch at its terminal point. Ramp 12 preferably terminates at a point adjacent hole 96 so that inward-leading ball 12 will fall off ramp 12 and onto plate 95 at the same time or just before outward-trailing ball 14 falls into hole 96. Thus, the end of ramp 12 and support piece 98 operate as a barrier to prevent inward-leading ball 13 from following outward-trailing ball 14 into hole 96. If only one ball is in an aperture as it approaches hole 96, the outward edge portion of ramp 12 will contact the ball and guide it to hole 96.

What is claimed is:

1. In a ball projecting machine of the type having a frame, a ball hopper for holding a supply of balls and having an opening in the bottom thereof, an elongated feed tube, a rotatable feeding apparatus for singly feeding the balls to the elongated feed tube mounted below the hopper with the feed tube being adapted at its receiving end to receive balls from the hopper opening and at its discharge end to deliver balls to a ball projecting mechanism, an electric motor means for driving the feeding apparatus and having in conjunction therewith control means for controlling the energization and speed thereof, an improved feeding apparatus comprising:

a. a horizontally-positioned apertured disc rotatably mounted on the machine from below the hopper opening and being connected for being driven by said motor means, said disc having a selected number of apertures of sufficient size to receive at least two balls per aperture, each said aperture being shaped so as to have both an inward-leading ball holding area and an outward-trailing ball holding area whereby balls will tend to be forced toward the said outward-trailing area by the centrifugal force created by the rotation of the disc and by the inertia of balls;

b. a support plate member fixed below and parallel to and underlying said disc, said plate member having a hole communicating with the receiving end of the machine ball feed tube and positioned below the path of the outward-trailing ball holding area of said apertures in said disc so as to receive and pass a ball from the outward-trailing ball holding area of each of said apertures into said feed tube as each of said apertures passes over said hole; and c. a ramp member located on said support plate ahead of the ball-approach side of said hole and terminating adjacent said hole, said ramp member having a height at its terminal point less than the distance between said disc and said plate member and having a curvature as viewed in plan adapted to cause each successive ball in the inward-leading area of each successive aperture to pass over said ramp member and to be elevated as it approaches said hole so as to urge any adjacent ball in the outward-trailing area of the same aperture into said hole and to prevent a elevated ball in such aperture from entering said hole.

2. The apparatus of claim 1 wherein said apertures are kidney-shaped.

3. In a ball projecting machine of the type having a frame, a ball hopper for holding a supply of balls and having an opening in the bottom thereof, a rotatable feeding apparatus for singly feeding the balls to an elongated feed tube mounted below the hopper with the feed tube being adapted at its receiving end to receive balls from the hopper opening and at its discharge end to deliver balls to a ball projecting mechanism, an electric motor means for driving the feeding apparatus and having in conjunction therewith control means for controlling the energization and speed thereof, an improved feeding apparatus comprising:

a. a horizontally-positioned apertured disc rotatably mounted on the machine frame below the hopper opening and being connected for being driven by said motor means, said disc having a selected number of apertures of sufficient size to receive at least two balls per aperture, each said aperture being shaped so as to have both an inward-leading ball holding area and an outward-trailing ball holding area whereby balls will tend to be forced toward the said outward-trailing area by the centrifugal force created by the rotation of the disc and by the inertia of balls;

b. a support member fixed below and parallel to and underlying said disc, said plate member having a hole communicating with the receiving end of the machine ball feed tube and positioned below the path of the outward-trailing ball holding area of said apertures in said disc so as to receive and pass a ball from the outward-trailing ball holding area of each of said apertures into said feed tube as each of said apertures passes over said hole; and c. deflector means secured to the upper surface of said support plate ahead of the ball-approach side of said hole for deflecting the path of each successive ball in the inward-leading area of each successive aperture so as to urge any adjacent ball in the outward-trailing area of the same aperture into said hole and to prevent a ball in the inward-leading area in such aperture from entering said hole.

* * * * *

UNITED STATES PATENT OFFICE

CERTIFICATE OF CORRECTION

Patent No. 3,978,841 Dated September 7, 1976

Inventor(s) Alfredo S. Yarur,et al.

It is certified that error appears in the above-identified patent and that said Letters Patent are hereby corrected as shown below:

Col. 1, line 13, insert --used-- after "machines.

Col. 1, line 41, "3,77,732" should be --3,777,732--.

Col. 1, line 42, "377,732" should be --3,777,732--.

Col. 2, line 6, insert --hopper and a-- before "feed tube".

Col. 3, line 4, insert --,-- after "49".

Col. 3, line 13, insert --do-- after "forces".

Col. 3, line 28, "therby" should be --thereby--.

Col. 4, line 36, insert --from-- after the 2nd occurrence of "balls".

Col. 5, line 27, "from" should be --frame--.

Signed and Sealed this

Twenty-eighth Day of December 1976

[SEAL]

*Attest:*

RUTH C. MASON
*Attesting Officer*

C. MARSHALL DANN
*Commissioner of Patents and Trademarks*